US007704106B2

(12) United States Patent
Koellmann

(10) Patent No.: US 7,704,106 B2
(45) Date of Patent: Apr. 27, 2010

(54) ELECTRICAL TERMINAL AND SPRING-FORCE TERMINAL CONNECTION THEREFOR

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/166,509

(22) Filed: Jul. 2, 2008

(65) Prior Publication Data

US 2009/0017704 A1 Jan. 15, 2009

(30) Foreign Application Priority Data

Jul. 13, 2007 (DE) ..... 10 2007 033 097

(51) Int. Cl.
*H01R 4/46* (2006.01)

(52) U.S. Cl. ..... 439/834

(58) Field of Classification Search ..... 439/834, 439/835, 828, 441, 438; 174/35, 79, 84 C
See application file for complete search history.

(56) References Cited

U.S. PATENT DOCUMENTS 4,139,256 A * 2/1979 Seidler ..... 439/852
6,095,874 A * 8/2000 Quaranta ..... 439/852
6,776,670 B2 * 8/2004 Suss ..... 439/834
6,875,062 B2 * 4/2005 Bouley et al. ..... 439/834

FOREIGN PATENT DOCUMENTS

| | | |
|---|---|---|
| DE | 2005923 | 2/1970 |
| DE | 30 19 149 A1 | 11/1981 |
| DE | 1917503 | 4/1996 |
| DE | 19711051 | 9/1998 |
| DE | 19939572 | 3/2000 |
| DE | 3019149 C2 | 11/2001 |
| DE | 10239273 | 3/2004 |
| EP | 0924799 | 6/1999 |

* cited by examiner

*Primary Examiner*—Alexander Gilman
(74) *Attorney, Agent, or Firm*—Whitham Curtis Christofferson & Cook, PC

(57) ABSTRACT

The invention describes a spring-force terminal connection (2) for electrical conductors with a busbar section (5) and a bent leaf spring (3), which has a bearing limb (7), which is supported on the busbar section (5), a spring bend section (11), which adjoins the bearing limb (7), and a clamping limb (8), which adjoins the spring bend section (11), for fixedly clamping a conductor to the busbar section (5). Those parts (12*a*, 12*b*) of the leaf spring (3) which merge with the bearing limb (7) and the clamping limb (8) run in the spring bend section (11) at least partially parallel to one another and bear against one another.

13 Claims, 2 Drawing Sheets

ELECTRICAL TERMINAL AND SPRING-FORCE TERMINAL CONNECTION THEREFOR

BACKGROUND OF THE INVENTION

1. Field of the Invention

The invention relates to a spring-force terminal connection for electrical conductors with a busbar section and a bent leaf spring, which has a bearing limb, which is supported on the busbar section, a spring bend section, which adjoins the bearing limb, and a clamping limb, which adjoins the spring bend section, for fixedly clamping a conductor to the busbar section.

2. Background Description

The invention furthermore relates to an electrical terminal with at least one such spring-force terminal connection, which is inserted into an insulating housing of the electrical terminal.

DE 197 11 051 A1 discloses a connecting terminal for electrical conductors, with a spring-force terminal connection, which has a bent clamping spring formed from spring sheet steel with bearing limbs, which are connected to one another via a spring bend, and clamping limbs and a busbar, which is inserted into the clamping limb and bears against the bearing limb. A conductor insertion channel, which extends from the rear spring bend of the clamping spring along the bearing limb and the busbar, is provided in the insulating housing of the terminal.

Another embodiment of screwless connection terminals is described in DE 30 19 149 C2. In this case, the end of a bearing limb, which is positioned at an angle, of a bent clamping spring rests on a conductor end by means of spring force, which conductor end has been inserted through a conductor insertion channel into a free cavity.

DE 102 39 273 A1 discloses a spring-force terminal connection for an electrical conductor, in which the clamping limb end of a leaf spring dips into a rectangular material passage in a busbar section in such a way that the clamping limb end with a hole collar inner wall face of the material passage forms a clamping point for the electrical conductor. The bearing limb is supported on that side of the material passage which is opposite the clamping point. In this case, too, the leaf spring is provided with a U-shaped spring bend section.

As a result of the positioning of the conductor insertion channel known, for example, from DE 197 11 051 A1 with a substantial part of its length below the bearing limb of the clamping spring, a reduction in the physical height of the terminal component part in the direction of extent of the conductor insertion channel is already achieved.

Against this background, the present invention is based on the object of further reducing the physical width of clamping component parts in the direction of the spring excursion of the clamping spring.

The object is achieved by the spring-force terminal connection of the type mentioned at the outset by virtue of the fact that, in the spring bend section, those parts of the leaf spring which merge with the bearing limb and the clamping limb run at least partially parallel to one another and bear against one another.

In contrast to the previously known leaf springs bent in the form of a U in which the spring bend section has a considerable radius, with the spring-force terminal connection according to the invention the distance between those parts of the spring bend section which run parallel to one another and therefore the radius of the spring bend is reduced to a maximum extent, with the result that these two parts, which merge with the bearing limb and the clamping limb, of the spring bend section bear at least partially against one another. This means that the minimum physical width predetermined with respect to one another by the radius of the spring bend in the direction of the spring excursion of a clamping component part can be reduced.

The spring bend section with a reduced radial extent can preferably be realized by virtue of the fact that the leaf spring is folded over in the spring bend section, with the result that those parts of the leaf spring which bear against one another are connected to one another in the spring bend section via a 180° bend in the leaf spring. The leaf spring can therefore be produced from spring sheet steel which is folded over by means of a suitable shaping process.

As an alternative to this, however, the leaf spring can also be produced from two parts of spring sheet steel. In this case, the leaf spring is formed from a first part, which contains the bearing limb, and a separate second part, which contains the clamping limb. These two separate parts are then connected to one another so as to form the bent integral leaf spring at the spring bend sections, which run parallel to one another, of the two parts. In order to provide a spring excursion which is as great as possible, the connection should take place at the ends of the parallel spring bend sections.

Those parts of the leaf spring which bear against one another in the spring bend section can be connected to one another by means of riveting, welding, adhesive bonding or an interlocking connection.

The spring-force terminal connection can be configured, for example in design terms, in the manner known from DE 197 11 051 A1. In this case, the clamping limb of the leaf spring has a cutout and is bent back towards the bearing limb in such a way that the busbar section, which bears against the bearing limb, extends away from the bearing limb through the cutout, and the limit of the cutout at the end of the clamping limb together with the busbar section forms a clamping point for a conductor, which is plugged from the spring bend in the direction of the cutout and through the cutout.

However, it is conceivable for the spring-force terminal connection to be configured so as to have the design known in principle from DE 102 39 273 A1. In this case, the busbar section is manufactured from a flat material and has a conductor plug-through opening. The leaf spring dips into the conductor plug-through opening and forms, with the material passage of the conductor plug-through opening, a clamping point by virtue of the clamping limb of the leaf spring in the rest position, in which there is no conductor inserted into the conductor plug-through opening, bearing in sprung fashion against a clamping section at the conductor plug-through opening. In this case, the bearing limb preferably likewise extends into the conductor plug-through opening and is supported on that inner edge of the conductor plug-through opening which is opposite the clamping point. However, it is also conceivable for the bearing limb to be fastened in another way on the busbar section.

SUMMARY OF THE INVENTION

The object is furthermore achieved by an electrical terminal with at least one such spring-force terminal connection. In this case, the insulating housing likewise has a conductor insertion channel, which adjoins the bearing limb and merges with a clamping point formed by the clamping limb and the busbar section, and an actuation channel, which adjoins that part of the spring bend section which merges with the clamping limb, adjacent to the spring terminal connection and opposite the conductor insertion channel, and runs towards the clamping limb. An actuating tool, for example a screwdriver, can be inserted into this actuation channel in order to move the clamping limb away from the clamping point and to make it possible to insert and fixedly clamp a conductor or to unclamp a conductor from the clamping point.

The leaf spring preferably forms a wall for the conductor insertion channel and the actuation channel, with the result that the physical width in the direction of the spring excursion is further reduced.

It is furthermore advantageous if the longitudinal axes of the conductor insertion channel and of the actuation channel run approximately parallel to one another. The maximum reduction in the radius of the spring bend of the leaf spring results in the actuation channel only needing to have a slight incline, or no incline at all, with respect to the longitudinal axis of the conductor insertion channel. This also results in a further reduction in the physical width in the direction of the spring excursion of the electrical terminal.

BRIEF DESCRIPTION OF THE DRAWINGS

The invention will be explained in more detail below with reference to the attached drawings using an exemplary embodiment. In the drawings.

DETAILED DESCRIPTION OF THE PREFERRED EMBODIMENTS OF THE INVENTION

Figure 1:
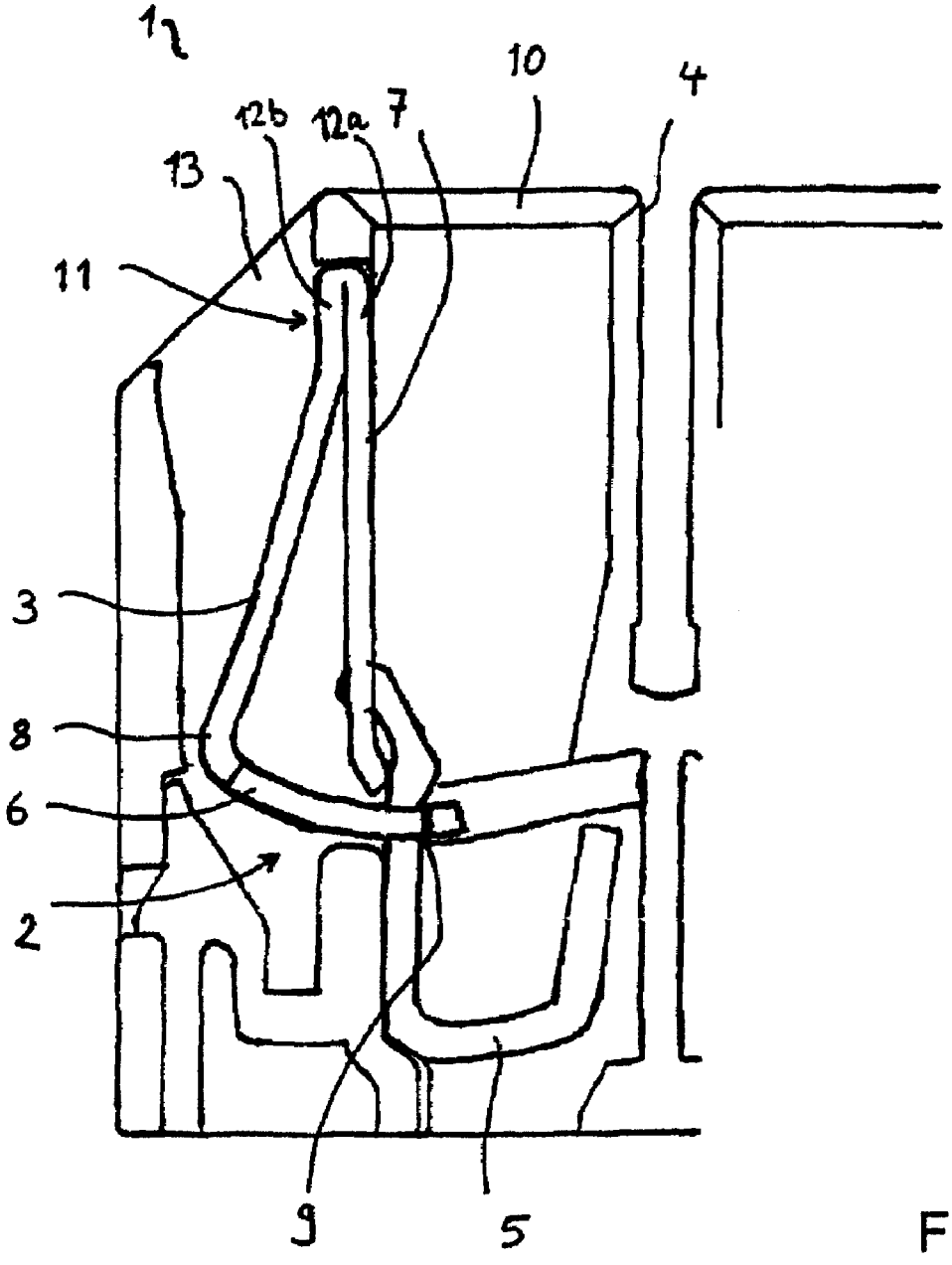
FIG. 1 shows a cross-sectional view of an electrical terminal with a spring-force terminal connection in the rest position.

FIG. 1 shows a cross-sectional view of an electrical terminal 1 with a spring-force terminal connection 2 in the rest position, in which a leaf spring 3, as a result of its spring force, springs back into a clamping position.

The electrical terminal 1 has an insulating housing 4, into which the spring-force terminal connection 2 is integrated. The spring-force terminal connection 2 in this case comprises the leaf spring 3 and a busbar section 5, which, by way of example, is bent in the manner illustrated and is plugged through a cutout 6 in the leaf spring 3. The leaf spring 3 is supported with a bearing limb 7 on the busbar section 5, which is correspondingly plugged into or through a receptacle formed in the bearing limb with it being bent back in the direction of the bearing limb 7.The leaf spring 3 furthermore has a clamping limb 8, in which the cutout for passing through the busbar section 5 and a conductor end (not illustrated) is introduced. That end of the clamping limb 8 which forms the limit for the cutout 6 forms, together with that section of the busbar section 5 which is located in this region, a clamping point 9 for an electrical conductor, which is guided through a conductor plug-through opening 10 past the spring-force terminal connection 2 and through the cutout 6 into the cage formed by the busbar 5 beneath the clamping limb 8.

The figure shows that the bearing limb 7 and the clamping limb 8, which is bent back in the direction of the bearing limb 7 and the busbar section 9, merges with a common spring bend section 11. That part 12*a* of the leaf spring 3 which merges with the bearing limb 7 and that part 12*b* of the leaf spring 3 which merges with the clamping limb 8 run parallel to one another and bear against one another in the region of the spring bend section 11. In contrast to the spring bend sections with a large radius, in which the deflected parts of the leaf spring 3 are not in touching contact with one another, the physical width of the spring-force terminal connection 2 is reduced to an extreme extent in the deflection direction of the leaf spring 3 by the extreme reduction in the bend such that those parts 12*a*, 12*b* of the spring bend section which merge with the bearing limb 7 and the clamping limb 8 are in touching contact with one another.

The spring bend section 11 can be produced, as illustrated, by the leaf spring 3, which is formed from integral spring sheet metal, being folded over. The folding over can take place during heating of the spring bend section 11. A shaping process in conjunction with laser annealing or an induction heating process is advantageous. A folded-over spring bend section 11 can also be achieved by means of electrical heating by means of current-conducting electrodes, which bear against the parts 12*a*, 12*b* of the spring bend section 11 and compress them.

The production of the spring bend section 11 with its reduced extent can also be achieved by virtue of the leaf spring 3 being produced from two parts of spring sheet metal, with the two parts being connected to one another, for example by means of riveting, welding or adhesive bonding, so as to form the integral leaf spring 3 having bearing and clamping limbs 7, 8.

The actuation of the spring-force terminal connection 2 takes place via an actuation channel 13, in which an actuating tool, such as a screwdriver, for example, can be inserted. With the aid of the actuating tool, the clamping limb 8 is moved out of the rest position (towards the right in the embodiment illustrated) in order to release the clamping point and to make it possible to plug a conductor through the conductor insertion channel 10 through the cutout 6 or to unclamp a fixedly clamped conductor again.

Figure 2:
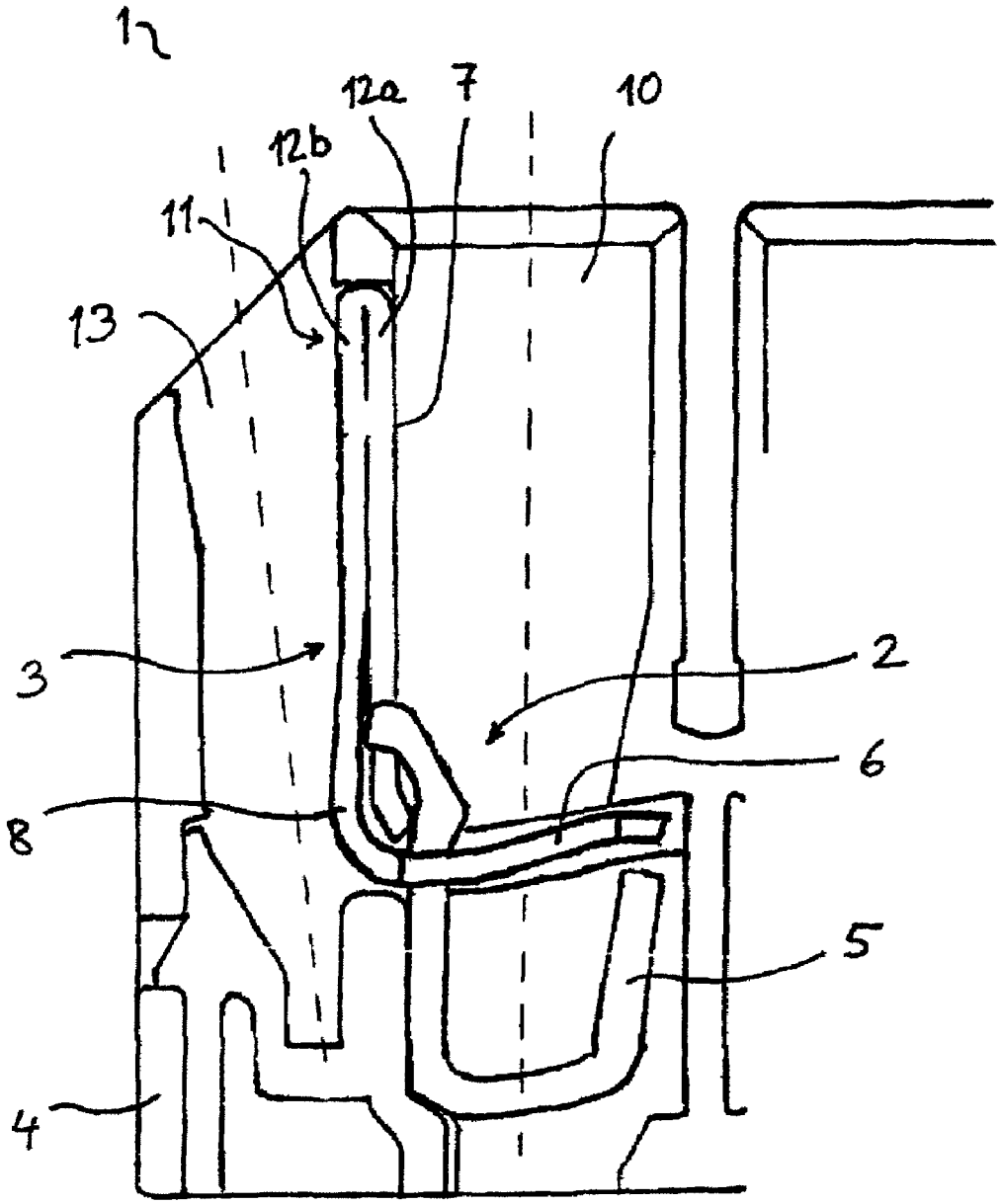
FIG. 2 shows an electrical terminal from FIG. 1 with a spring-force terminal connection in the actuation position.

FIG. 2 shows the electrical terminal 1 from FIG. 1 in the actuation position. This figure shows that the clamping limb 8 has now been moved to such an extent that the cutout 6 is in the conductor insertion channel 10, with the result that a conductor which has been plugged through the conductor insertion channel 10 is automatically also guided through the cutout into the cage formed by the bent busbar section 5. If the actuating tool is now removed from the actuation channel 13, the clamping limb 8 of the leaf spring 3 is moved towards the left again until the conductor end which is passed through the cutout 6 is pressed against the busbar section 5 in a manner known per se with the aid of that end of the clamping limb 8 which forms the limit for the cutout 6 and is fixed there.

FIG. 2 further shows the longitudinal axes of the conductor insertion channel 10 and the actuation channel 13. The figure shows that these longitudinal axes are only slightly offset at an angle with respect to one another. The angle is approximately from 0 to 10 degrees, preferably from 5 to 7 degrees. This approximately parallel alignment of the conductor insertion channel 10 and the actuation channel 13 is made possible by virtue of the fact that the extent of the spring bend section 11 is considerably reduced.

The embodiment illustrated of an electrical terminal 1 is only one possible variant for the use of a spring-force terminal connection 3 with a spring bend section 11 having a reduced extent. Other use forms in known electrical terminals are conceivable in which the leaf spring with the spring bend section 11 having a large radius are replaced by the present spring-force terminal connection 2.

The invention claimed is:

1. Spring-force terminal connection for electrical conductors comprising:

a busbar section, and a bent leaf spring for fixedly clamping a conductor to the busbar section, wherein the leaf spring comprises a bearing limb supported on the busbar section, a spring bend section adjoining the bearing limb, and a clamping limb adjoining the spring bend section, wherein the leaf spring is folded over in the spring bend section forming a fold, and wherein, in the spring bend section, those parts of the leaf spring which merge with the bearing limb and the clamping limb which adjoins the fold run at least partially parallel to one another and bear against one another.

2. Spring-force terminal connection according to claim 1, wherein the leaf spring is folded over in the spring bend section, resulting in those parts of the leaf spring that bear against one another being connected to one another in the spring bend section via a 180° bend in the leaf spring.

3. Spring-force terminal connection for electrical conductors comprising:

a busbar section; and a bent leaf spring for fixedly clamping a conductor to the busbar section, wherein the leaf spring comprises a bearing limb supported on the busbar section, a spring bend section adjoining the bearing limb, and a clamping limb adjoining the spring bend section, wherein the leaf spring is formed from a first part containing the bearing limb, and a separate second part containing the clamping limb, and wherein the first part and the separate second part are connected to one another so as to form the bent leaf spring at spring bend sections, which run parallel to one another, of the two parts.

4. Spring-force terminal connection according to claim 3, wherein those parts of the leaf spring which bear against one another are connected to one another in the spring bend section by means of riveting, welding or adhesive bonding.

5. Spring-force terminal connection according to claim 3, wherein the clamping limb of the leaf spring has a cutout and is bent back towards the bearing limb in such a way that the busbar section, which bears against the bearing limb, extends away from the bearing limb through the cutout, and the limit of the cutout at the end of the clamping limb together with the busbar section forms a clamping point for a conductor, which is plugged from the spring bend section in the direction of the cutout and through the cutout.

6. Spring-force terminal connection according to claim 3, wherein the busbar section is manufactured from a flat material and has a conductor plug-through opening, and the leaf spring dips into the conductor plug-through opening, and wherein the clamping limb of the leaf spring bears in sprung fashion against a clamping section of the busbar section in the rest position without a conductor plugged into the conductor plug-through opening.

7. Spring-force terminal connection according to claim 6, wherein the bearing limb extends into the conductor plug-through opening and bears against an inner edge of the conductor plug-through opening, the inner edge being opposite to the clamping section.

8. Electrical terminal with at least one spring-force terminal connection for electrical conductors comprising:

a busbar section; and a bent leaf spring for fixedly clamping a conductor to the busbar section, wherein the leaf spring comprises a bearing limb supported on the busbar section, a spring bend section adjoining the bearing limb, and a clamping limb adjoining the spring bend section, wherein the leaf spring is folded over in the spring bend section forming a fold, and wherein, in the spring bend section, those parts of the leaf spring which merge with the bearing limb and the clamping limb which adjoins the fold run at least partially parallel to one another and bear against one another, the at least one spring-force terminal connection being inserted into an insulating housing of the electrical terminal, characterized in that the insulating housing has a conductor insertion channel, which adjoins the bearing limb and merges with a clamping point formed by the clamping limb and the busbar section, and an actuation channel, which adjoins that part of the spring bend section which merges with the clamping limb, adjacent to the spring terminal connection and opposite the conductor insertion channel, and runs towards the clamping limb.

9. Electrical terminal according to claim 8, characterized in that the leaf spring forms a wall of the conductor insertion channel and the actuation channel.

10. Electrical terminal according to claim 8, wherein longitudinal axes of the conductor insertion channel and of the actuation channel run approximately parallel to one another.

11. Electrical terminal with at least one spring-force terminal connection for electrical conductors comprising:

a busbar section; and a bent leaf spring for fixedly clamping a conductor to the busbar section, wherein the leaf spring comprises a bearing limb supported on the busbar section, a spring bend section adjoining the bearing limb, and a clamping limb adjoining the spring bend section, wherein the leaf spring is formed from a first part containing the bearing limb, and a separate second part containing the clamping limb, wherein the first part and the separate second part are connected to one another so as to form the bent leaf spring at spring bend sections, the spring bend sections running parallel to one another in the area of the connection between the first part and the separate second part, the at least one spring-force terminal connection being inserted into an insulating housing of the electrical terminal, and wherein the insulating housing has a conductor insertion channel adjoining the bearing limb and merging with a clamping point formed by the clamping limb and the busbar section, and an actuation channel adjoining that part of the spring bend section that merges with the clamping limb, adjacent to the spring terminal connection and opposite the conductor insertion channel, and runs towards the clamping limb.

12. Electrical terminal according to claim 11, wherein the leaf spring forms a wall of the conductor insertion channel and the actuation channel.

13. Electrical terminal according to claim 11, wherein longitudinal axes of the conductor insertion channel and of the actuation channel run approximately parallel to one another.

* * * * *